US011663952B2

(12) United States Patent
Kim et al.

(10) Patent No.: US 11,663,952 B2
(45) Date of Patent: May 30, 2023

(54) DISPLAY DEVICE

(71) Applicant: LG DISPLAY CO., LTD., Seoul (KR)

(72) Inventors: Minsu Kim, Goyang-si (KR); Jungchul Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/551,896

(22) Filed: Dec. 15, 2021

(65) Prior Publication Data

US 2022/0198987 A1 Jun. 23, 2022

(30) Foreign Application Priority Data

Dec. 22, 2020 (KR) ..... 10-2020-0180725

(51) Int. Cl.
*G09G 3/20* (2006.01)

(52) U.S. Cl.
CPC ... *G09G 3/2074* (2013.01); *G09G 2310/0248* (2013.01); *G09G 2310/0251* (2013.01); *G09G 2320/064* (2013.01)

(58) Field of Classification Search
CPC ..... G09G 3/2074; G09G 2320/064; G09G 2300/0426; G09G 2300/0452; G09G 2320/0219; G09G 2320/0247; G09G 2340/0435; G09G 3/3233
See application file for complete search history.

(56) References Cited

U.S. PATENT DOCUMENTS

2007/0146278 A1 6/2007 Pan et al.
2015/0102312 A1 4/2015 Lee et al.
2017/0125506 A1 5/2017 Kim
2018/0090061 A1 3/2018 Kim et al.
2019/0088208 A1 3/2019 Chang et al.
2021/0012711 A1* 1/2021 Huang ..... G09G 3/3291

FOREIGN PATENT DOCUMENTS

EP 3 680 889 A1 7/2020
KR 10-2020-0087711 A 7/2020

OTHER PUBLICATIONS

The extended European search report dated May 16, 2022 issued in Patent Application No. 21215677.2 (17 pages).

* cited by examiner

*Primary Examiner* — Adam R. Giesy
(74) *Attorney, Agent, or Firm* — Polsinelli PC

(57) ABSTRACT

A display device include a substrate on which a plurality of first sub-pixels disposed in first columns and a plurality of second sub-pixels disposed in second columns are defined; a plurality of data lines disposed on one sides of the plurality of first sub-pixels and the other sides of the plurality of second sub-pixels; and a plurality of parking voltage lines disposed between the plurality of first sub-pixels and the plurality of second sub-pixels, wherein the plurality of parking voltage lines are configured to be electrically connected to some of the plurality of data lines. Accordingly, by applying the same parking voltage to the parking voltage lines and the data lines during a blank frame, flicker can be reduced.

17 Claims, 5 Drawing Sheets

DISPLAY DEVICE

CROSS-REFERENCE TO RELATED APPLICATION

This application claims the benefit of and priority to Korean Patent Application No. 10-2020-0180725 filed on Dec. 22, 2020, which is hereby incorporated by reference in its entirety.

BACKGROUND

Field of the Disclosure

The present disclosure relates to a display device, and more particularly, to a display device capable of stably compensating for luminance during frequency-variable driving.

Description of the Background

Display devices used in computer monitors, TVs, and mobile phones include organic light emitting displays that emit light by themselves, and liquid crystal displays (LCDs) that require a separate light source.

Such display devices are being applied to more and more various fields including not only computer monitors and TVs, but also personal mobile devices, and thus, display devices having a reduced volume and weight while having a wide display area are being studied.

Meanwhile, display devices may be driven in various methods to reduce power consumption. Among them, a method of varying a driving frequency of the display device at a high speed or a low speed according to a type of a displayed image is being used.

SUMMARY

Accordingly, the present disclosure is to provide a display device capable of stably compensating for luminance while reducing power consumption by varying a driving frequency.

The present disclosure is also to provide a display device in which a parasitic capacitance for luminance compensation is increased when a driving frequency is varied.

Further, the present disclosure is to provide a display device in which external noise caused by a touch signal is reduced.

The present disclosure is not limited to the above-mentioned features, which is not mentioned above, can be clearly understood by those skilled in the art from the following descriptions.

A display device according to an exemplary aspect of the present disclosure may include a substrate on which a plurality of first sub-pixels disposed in first columns and a plurality of second sub-pixels disposed in second columns are defined; a plurality of data lines disposed on one sides of the plurality of first sub-pixels and the other sides of the plurality of second sub-pixels; and a plurality of parking voltage lines disposed between the plurality of first sub-pixels and the plurality of second sub-pixels, wherein the plurality of parking voltage lines are configured to be electrically connected to some of the plurality of data lines. Accordingly, by applying the same parking voltage to the parking voltage lines and the data lines during a blank frame, flicker can be reduced.

A display according to another exemplary aspect of the present disclosure may include a substrate on which a plurality of first sub-pixels disposed in first columns and a plurality of second sub-pixels disposed in second columns are defined; a plurality of pixel circuits disposed in the plurality of first sub-pixels and the plurality of second sub-pixels; a plurality of data lines extending in a column direction between the plurality of first sub-pixels and the plurality of second sub-pixels and connected to the plurality of pixel circuits; and a plurality of parking voltage lines extending in the column direction between the plurality of first sub-pixels and the plurality of second sub-pixels and separated from the plurality of pixel circuits, wherein the plurality of parking voltage lines are disposed in columns in which the plurality of data lines are not disposed among a plurality of columns. Accordingly, a parasitic capacitance with the driving transistor can be increased and flicker can be reduced by disposing the parking voltage lines in columns in which the plurality of data lines are not disposed.

Other detailed matters of the exemplary aspects are included in the detailed description and the drawings.

According to the present disclosure, power consumption of a display device can be reduced by varying a driving frequency of the display device.

According to the present disclosure, when the driving frequency of the display device is varied, luminance variation can be minimized.

According to the present disclosure, luminance can be stably compensated by increasing a parasitic capacitance for luminance compensation.

The effects according to the present disclosure are not limited to the contents exemplified above, and more various effects are included in the present specification.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure.

In the drawings.

DETAILED DESCRIPTION

Figure 1:
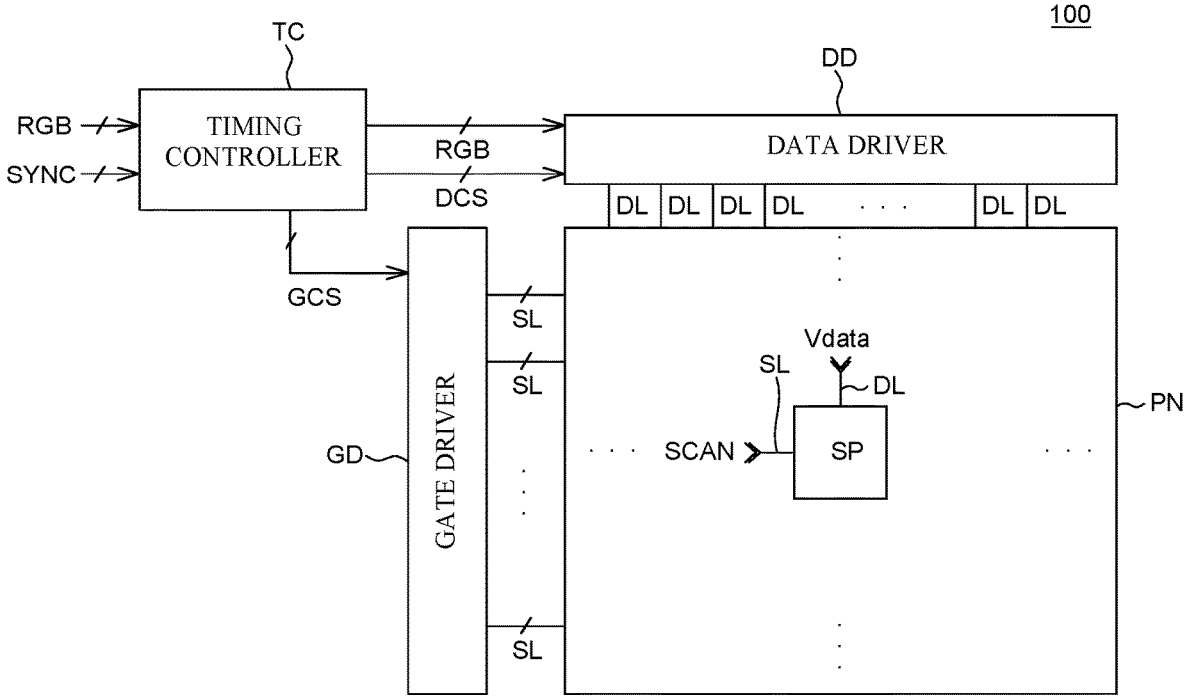
FIG. 1 is a schematic configuration diagram of a display device according to an exemplary aspect of the present disclosure.

Advantages and characteristics of the present disclosure and a method of achieving the advantages and characteristics will be clear by referring to exemplary aspects described below in detail together with the accompanying drawings. However, the present disclosure is not limited to the exemplary aspects disclosed herein but will be implemented in various forms. The exemplary aspects are provided by way of example only so that those skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary aspects of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "comprising" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is disposed "on" another element or layer, another layer or another element may be interposed directly on the other element or therebetween.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Same reference numerals generally denote same elements throughout the specification.

A size and a thickness of each component illustrated in the drawing are illustrated for convenience of description, and the present disclosure is not limited to the size and the thickness of the component illustrated.

The features of various aspects of the present disclosure can be partially or entirely adhered to or combined with each other and can be interlocked and operated in technically various ways, and the aspects can be carried out independently of or in association with each other.

Hereinafter, a display device according to exemplary aspects of the present disclosure will be described in detail with reference to accompanying drawings.

FIG. 1 is a schematic configuration diagram of a display device according to an exemplary aspect of the present disclosure. In FIG. 1, only a display panel PN, a gate driver GD, a data driver DD, and a timing controller TC among various components of a display device 100 are illustrated for convenience of explanation.

Referring to FIG. 1, the display device 100 includes the display panel PN including a plurality of sub-pixels SP, and the gate driver GD and the data driver DD for supplying various signals to the display panel PN, and the timing controller TC for controlling the gate driver GD and the data driver DD.

The timing controller TC aligns image data RGB input from the outside and supplies it to the data driver DD. The timing controller TC may generate a gate control signal GCS and a data control signal DCS using synchronization signals SYNC input from the outside, for example, a dot clock signal, a data enable signal, and a horizontal/vertical synchronization signal. In addition, the timing controller TC may supply the generated gate control signal GCS and data control signal DCS to the gate driver GD and the data driver DD, respectively, to thereby control the gate driver GD and the data driver DD.

The gate driver GD supplies a plurality of scan voltages SCAN to a plurality of scan lines SL according to a plurality of gate control signals GCS provided from the timing controller TC. Although it is illustrated in FIG. 1 that the gate driver GD is disposed to be spaced apart from one side of the display panel PN, the number and arrangement of gate drivers GD are not limited thereto.

The data driver DD converts image data RGB input from the timing controller TC into a data volage Vdata using a reference gamma voltage according to a plurality of data control signals DCS provided from the timing controller TC. In addition, the data driver DD may supply the converted data volage Vdata to a plurality of data lines DL.

The display panel PN, a component for displaying an image to a user, includes the plurality of sub-pixels SP. In the display panel PN, the plurality of scan lines SL and the plurality of data lines DL cross each other, and each of the plurality of sub-pixels SP is connected to the scan line SL and the data line DL. In addition, although not illustrated in the drawings, each of the plurality of sub-pixels SP may be connected to a high potential power line, a low potential power line, an initialization signal line, an emission control signal line, and the like.

The plurality of sub-pixels SP are minimum units constituting a screen, and each of the plurality of sub-pixels SP includes a light emitting element and a pixel circuit for driving the light emitting element. A plurality of light emitting elements may be differently defined according to a type of the display panel PN. For example, when the display panel PN is an organic light emitting display panel, the light emitting element is an organic light emitting element including an anode, an organic layer, and a cathode. In addition, a quantum dot light emitting diode (QLED) including a quantum dot (QD), or the like may be used as the light emitting element. Hereinafter, a description will be made on the assumption that the light emitting element is an organic light emitting element, but a type of the light emitting element is not limited thereto.

The pixel circuit is a circuit for controlling driving of the light emitting element. The pixel circuit may be configured to include a plurality of transistors and a capacitor, but is not limited thereto.

Hereinafter, the plurality of sub-pixels SP will be described in more detail with reference to FIG. 2.

Figure 2:
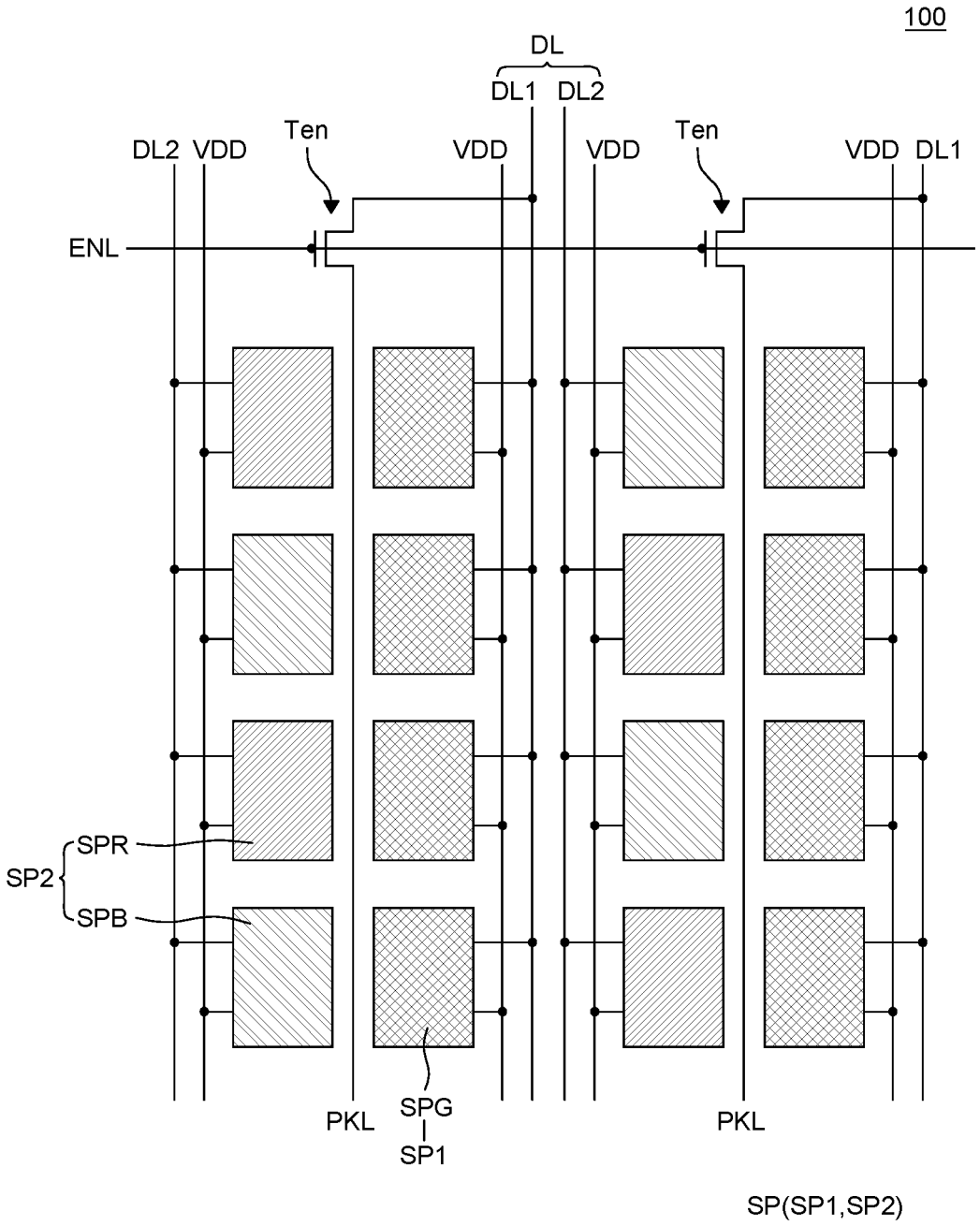
FIG. 2 is a schematic enlarged plan view of the display device according to an exemplary aspect of the present disclosure.

FIG. 2 is a schematic enlarged plan view of the display device according to an exemplary aspect of the present disclosure. In FIG. 2, only the plurality of data lines DL, a plurality of high potential power lines VDD, a plurality of parking voltage lines PKL, and an enable line ENL among a plurality of lines are illustrated for convenience of explanation.

The plurality of sub-pixels SP includes a plurality of first sub-pixels SP1 and a plurality of second sub-pixels SP2 that emit light of different colors. For example, the plurality of first sub-pixels SP1 may include green sub-pixels SPG, and the plurality of second sub-pixels SP2 may include red sub-pixels SPR and blue sub-pixels SPB.

The plurality of first sub-pixels SP1 may be disposed in first columns among a plurality of columns. That is, the plurality of first sub-pixels SP1 may be disposed in the same columns. In addition, the plurality of second sub-pixels SP2 may be disposed in a plurality of second columns between a plurality of the first columns among the plurality of columns. For example, the plurality of first sub-pixels SP1 may be disposed in one first column, and the plurality of second sub-pixels SP2 may be disposed together in the second column adjacent to the one first column. That is, each of the second columns may be disposed adjacent to a first column. In addition, the red sub-pixels SPR and the blue sub-pixels SPB of the plurality of second sub-pixels SP2 may be alternately disposed in the same column.

In the present disclosure, although it has been described that the plurality of sub-pixels SP include the first sub-pixels SP1 including green sub-pixels SPG, and the second sub-pixels SP2 including red sub-pixels SPR and blue sub-pixels SPB, the number, arrangements and colors of the plurality of sub-pixels SP may be variously changed according to a design. Accordingly, the present disclosure is not limited thereto.

The plurality of first sub-pixels SP1 and second sub-pixels SP2 may form a flip structure having a symmetrical structure. The plurality of first sub-pixels SP1 disposed in the plurality of first columns and the plurality of second sub-pixels SP2 disposed in the plurality of second columns may be symmetrical to each other with respect to the plurality of high potential power lines VDD and the plurality of data lines DL.

The plurality of data lines DL, the plurality of high potential power lines VDD, and the plurality of parking voltage lines PKL that extend in a column direction are disposed between the plurality of sub-pixels SP.

The plurality of data lines DL are lines that transmit a data voltage to each of the plurality of sub-pixels SP. The plurality of data lines DL are disposed on one side of the plurality of first sub-pixels SP1 and the other side of the plurality of second sub-pixels SP2, respectively. That is, each of the plurality of data lines is disposed on a first side of a first column of the plurality of first sub-pixels SP1 and on a second side of a second column of the plurality of second sub-pixels.

The plurality of data lines DL include first data lines DL1 and second data lines DL2. The first data line DL1 is disposed on one side of the plurality of first sub-pixels SP1 and is electrically connected to pixel circuits of the plurality of first sub-pixels SP1. The second data line DL2 is disposed on the other side of the plurality of second sub-pixels SP2 and is electrically connected to pixel circuits of the plurality of second sub-pixels SP2. The first data line DL1 is disposed between the plurality of first sub-pixels SP1 and the second data line DL2. The second data line DL2 is disposed between the plurality of second sub-pixels SP2 and the first data line DL1. For example, a plurality of the first data lines DL1 may be disposed on right sides of the plurality of first sub-pixels SP1 respectively, and a plurality of the second data lines DL2 may be disposed on left sides of the plurality of second sub-pixels SP2 respectively.

The plurality of high potential power lines VDD are disposed on one side of the plurality of first sub-pixels SP1 and the other side of the plurality of second sub-pixels SP2, respectively. The plurality of high potential power lines VDD are lines that transmit a high potential power voltage to each of the plurality of sub-pixels SP. Some high potential power lines VDD among the plurality of high potential power lines VDD may be disposed adjacent to the first data lines DL1 on one sides of the plurality of first sub-pixels SP1. The other high potential power lines VDD among the plurality of high potential power lines VDD may be disposed adjacent to the second data lines DL2 on the other sides of the plurality of second sub-pixels SP2. For example, some high potential power line VDD may be disposed between the first data line DL1 disposed on the right side of the plurality of first sub-pixels SP1 and the plurality of first sub-pixels SP1, and the other high potential power line VDD may be disposed between the second data line DL2 disposed on the left side of the plurality of second sub-pixels SP2 and the plurality of second sub-pixels SP2. However, an arrangement order of the plurality of high potential power lines VDD and the plurality of data lines DL between the first sub-pixels SP1 and the second sub-pixels SP2 may be varied, and is not limited thereto.

The plurality of parking voltage lines PKL are disposed between the plurality of first sub-pixels SP1 and the plurality of second sub-pixels SP2, or the plurality of parking voltage lines PKL extending in the column direction between the plurality of first sub-pixels SP1 and the plurality of second sub-pixels SP2 and separated from the plurality of pixel circuits. The plurality of parking voltage lines PKL may be disposed on the other sides of the plurality of first sub-pixels SP1 and on one sides of the plurality of second sub-pixels SP2. That is, each of the plurality of parking voltage lines PKL is disposed between the second side of a first column of the plurality of first sub-pixels and the first side of a second column of the plurality of second sub-pixels. The plurality of first sub-pixels SP1 may be disposed between the parking voltage line PKL and the first data line DL1, and the plurality of second sub-pixels SP2 may be disposed between the parking voltage line PKL and the second data line DL2. For example, the plurality of parking voltage lines PKL may be disposed on the left sides of the plurality of first sub-pixels SP1 and on the right sides of the plurality of second sub-pixels SP2. The plurality of parking voltage lines PKL may be disposed in columns in which the plurality of data lines DL are not disposed among a plurality of coluns.

The plurality of parking voltage lines PKL are lines that form a parasitic capacitance with a driving transistor in a blank frame to compensate for luminance, which will be described in more detail later with reference to FIGS. 3 to 5.

The plurality of parking voltage lines PKL may extend toward some data lines DL among the plurality of data lines DL and may be electrically connected to the some data lines DL. For example, the plurality of parking voltage lines PKL may be electrically connected to the first data lines DL1 that are electrically connected to the first sub-pixels SP1 among the plurality of data lines DL.

If the plurality of parking voltage lines PKL are electrically connected to the plurality of second data lines DL2, noise may be intensified by a data voltage that is applied to the plurality of second data lines DL2. The plurality of second data lines DL2 are data lines DL that are connected to the red sub-pixels SPR and the blue sub-pixels SPB, and the data voltage supplied to the plurality of second data lines DL2 may have a larger range of variance, compared to a data voltage supplied to the plurality of first data lines DL1 that are connected only to the green sub-pixels SPG. Accordingly, when the plurality of parking voltage lines PKL are connected to the second data lines DL2 having a relatively large range of variance in voltage, it may be difficult to form a stable a parasitic capacitance with the driving transistor, and noise may be intensified. Accordingly, the plurality of parking voltage lines PKL may be electrically connected to the plurality of first data lines DL1 connected to the plurality of green sub-pixels SPG.

Meanwhile, connection transistors Ten and an enable line ENL are disposed to control electrical connection between the plurality of parking voltage lines PKL and the plurality of first data lines DL1.

The connection transistors Ten are connected between the plurality of parking voltage lines PKL and the plurality of first data lines DL1. In detail, source electrodes and drain electrodes of the connection transistors Ten may be connected to the plurality of parking voltage lines PKL and the plurality of first data lines DL1, respectively.

In addition, the enable line ENL extends in a row direction and is electrically connected to a gate electrode of each of the plurality of connection transistors Ten. By applying a turn-on voltage or turn-off voltage of the connection transistor Ten to the enable line ENL, the connection transistor Ten may be turned on or off. For example, when a turn-on voltage of the connection transistor Ten is applied to the enable line ENL, the connection transistor Ten may be turned on to electrically connect the first data line DL1 and the parking voltage line PKL. For example, when a turn-off voltage of the connection transistor Ten is applied to the enable line ENL, the connection transistor Ten may be turned off to electrically separate the first data line DL1 and the parking voltage line PKL.

Hereinafter, the pixel circuit will be described in more detail with reference to FIGS. 3 to 5.

Figure 3:
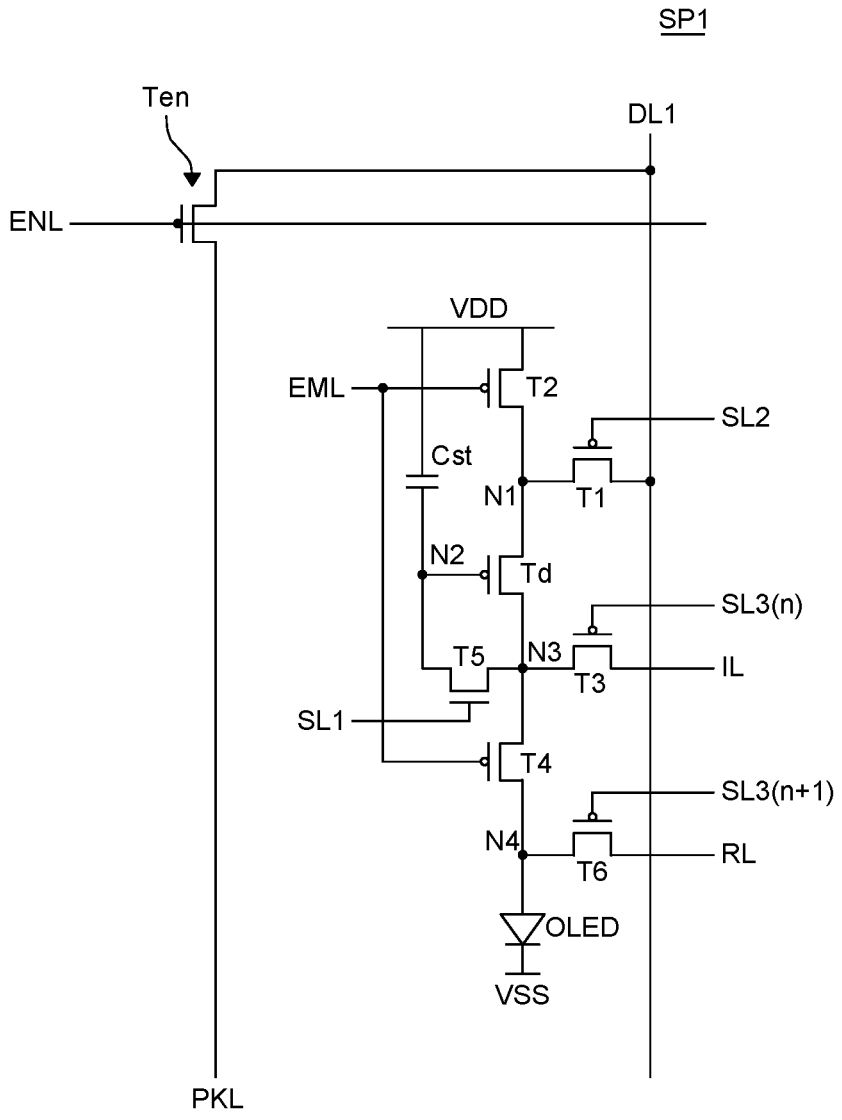
FIG. 3 is a pixel circuit diagram of a first sub-pixel of a display device according to an exemplary aspect of the present disclosure.

FIG. 3 is a pixel circuit diagram of a first sub-pixel of a display device according to an exemplary aspect of the present disclosure. FIG. 4 is a pixel circuit diagram of a second sub-pixel of a display device according to an exemplary aspect of the present disclosure. FIG. 5 is a timing diagram illustrating waveforms of signals input to the pixel circuit of the display device according to an exemplary aspect of the present disclosure. FIG. 3 is a circuit diagram of a pixel circuit of the first sub-pixel SP1 disposed in an n-th row among the plurality of sub-pixels SP, and FIG. 4 is a circuit diagram of a pixel circuit of the second sub-pixel SP2 disposed in the n-th row. A pixel circuit for driving a light emitting element OLED includes a driving transistor Td, a first transistor T1, a second transistor T2, a third transistor T3, a fourth transistor T4, a fifth transistor T5, a sixth transistor T6, and a storage capacitor Cst. Meanwhile, in FIGS. 3 and 4, for convenience of explanation, reference numerals "n" and "n+1" that distinguish a third scan line SL3($n$) in the n-th row and a third scan line SL3($n$+1) in an (n+1)-th row are described.

Referring to FIG. 3, the pixel circuit of the first sub-pixel SP1 disposed in the n-th row is electrically connected to a first scan line SL1 in the n-th row, a second scan line SL2 in the n-th row, the third scan line SL3($n$) in the n-th row, the third scan line SL3($n$+1) in the (n+1)-th row, the first data line DL1, the high potential power line VDD, a low potential power line VSS, an emission control signal line EML, initialization signal line IL, and anode reset line RL. In this case, the third scan line SL3($n$+1) in the (n+1)-th row is a line that is connected to the third transistor T3 of the sub-pixel SP in the (n+1)-th row.

First, the pixel circuit includes a plurality of transistors. The plurality of transistors may be formed of different types of transistors. For example, one of the plurality of transistors may be a transistor including an oxide semiconductor as an active layer. Since an oxide semiconductor material has a low off-current, it is suitable for a switching transistor that has a short turn-on time and a long turn-off time.

For example, the other of the plurality of transistors may be a transistor using low temperature poly-silicon (LTPS) as an active layer. Since a polysilicon material has high mobility, it has low power consumption and excellent reliability and thus, may be suitable for the driving transistor Td.

Meanwhile, the plurality of transistors may be N-type transistors or P-type transistors. In the N-type transistor, since carriers are electrons, electrons may flow from a source electrode to a drain electrode, and a current may flow from the drain electrode to the source electrode. In the P-type transistor, since carriers are holes, holes may flow from a source electrode to a drain electrode, and a current may flow from the source electrode to the drain electrode. For example, one transistor of the plurality of transistors may be an N-type transistor, and the other transistor of the plurality of transistors may be a P-type transistor.

For example, the fifth transistor T5 may be an N-type transistor and may be a transistor including an oxide semiconductor as an active layer. And, the driving transistor Td, the first transistor T1, the second transistor T2, the third transistor T3, the fourth transistor T4, and the sixth transistor T6 may be P-type transistors and may be transistors using low-temperature polysilicon as an active layer. However, materials constituting the active layer of the plurality of transistors and types of the plurality of transistors are exemplary and are not limited thereto.

First, the second transistor T2, the driving transistor Td, the fourth transistor T4, and the light emitting element OLED may be connected in series between the high potential power line VDD and the low potential power line VSS.

The second transistor T2 includes a gate electrode connected to the emission control signal line EML, a source electrode connected to the high potential power line VDD, and a drain electrode connected to a first node N1. The second transistor T2 may transmit a high potential power voltage to the first node N1 according to an emission control voltage that is applied to the emission control signal line EML.

The driving transistor Td includes a gate electrode connected to a second node N2, a source electrode connected to the first node N1, and a drain electrode connected to a third node N3. The driving transistor Td is a transistor that controls a driving current applied to the light emitting element OLED.

The fourth transistor T4 includes a gate electrode connected to the emission control signal line EML, a source electrode connected to the third node N3, and a drain electrode connected to a fourth node N4. The fourth transistor T4 may form a current path between the third node N3 that is connected to the driving transistor Td and the fourth node N4 that is connected to the light emitting element OLED according to the emission control voltage applied to the emission control signal line EML. In this case, since the gate electrodes of the second transistor T2 and the fourth transistor T4 are connected to the same emission control signal line EML, they may be turned on or off at the same time.

The light emitting element OLED has an anode that is connected to the fourth node N4 and a cathode that is connected to the low potential power line VSS. The light emitting element OLED may emit light by receiving a driving current that is controlled by the driving transistor Td.

The storage capacitor Cst is disposed between the high potential power line VDD and the second node N2. The storage capacitor Cst may include a first capacitor electrode that is connected to the high potential power line VDD and a second capacitor electrode that is connected to the gate electrode of the driving transistor Td through the second node N2. The storage capacitor Cst may store a constant voltage and maintain a constant voltage level of the gate electrode of the driving transistor Td during an emission period.

The fifth transistor T5 includes a gate electrode that is connected to the first scan line SL1, a source electrode that is connected to the second node N2, and a drain electrode that is connected to the third node N3. The fifth transistor T5 may short-circuit the gate electrode and the drain electrode of the driving transistor Td, and may diode-connect the driving transistor Td. In the diode connection, the gate electrode and the drain electrode are short-circuited so that the driving transistor Td operates like a diode. In this case, the fifth transistor T5 is implemented as an oxide semiconductor transistor having a low off current, so that leakage of a current from the gate electrode of the driving transistor Td may be minimized and flicker may be reduced.

The first transistor T1 includes a gate electrode that is connected to the second scan line SL2, a source electrode that is connected to the first data line DL1, and a drain electrode that is connected to the first node N1. When the first transistor T1 is turned on according to a second scan voltage applied to the second scan line SL2, the data voltage may be transmitted from the first data line DL1 to the first node N1.

The third transistor T3 includes a gate electrode that is connected to the third scan line SL3(*n*) in the n-th row, a source electrode that is connected to the third node N3, and a drain electrode that is connected to the initialization signal line IL. When the third transistor T3 is turned on according to a third scan voltage applied to the third scan line SL3(*n*) in the n-th row, an initialization voltage may be transmitted to the third node N3.

The sixth transistor T6 includes a gate electrode that is connected to the third scan line SL3(*n*+1) in the (n+1)-th row which is a next row of the n-th row, a source electrode that is connected to the fourth node N4, and a drain electrode that is connected to the anode reset line RL. When the sixth transistor T6 is turned on according to the third scan voltage applied to the third scan line SL3(*n*+1) in the (n+1)-th row, an anode reset voltage may be transmitted to the fourth node N4, which is the anode of the light emitting element OLED.

Figure 4:
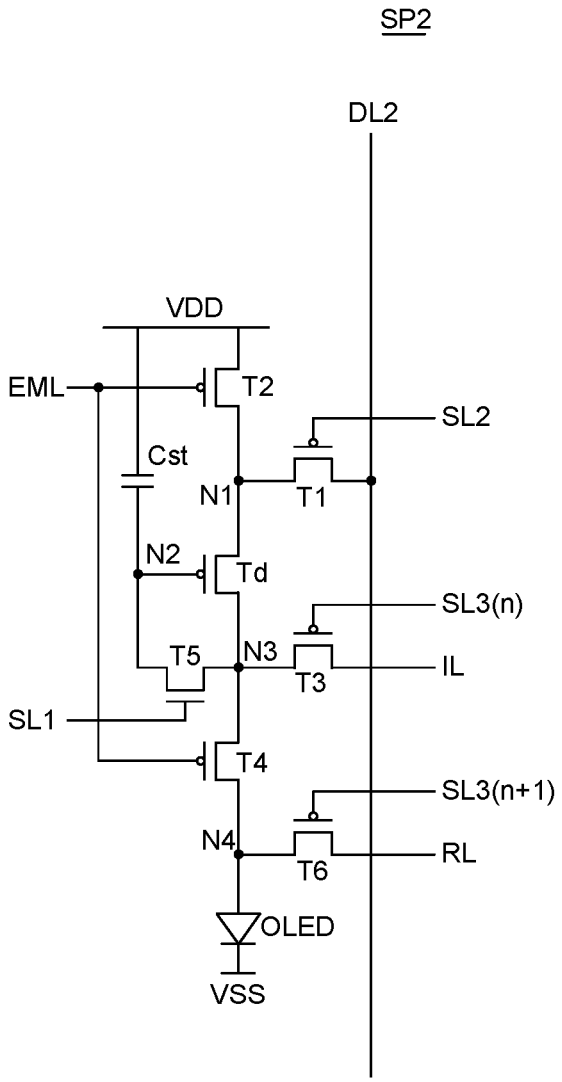
FIG. 4 is a pixel circuit diagram of a second sub-pixel of a display device according to an exemplary aspect of the present disclosure.

Referring to FIG. 4, the pixel circuit of the second sub-pixel SP2 is substantially identical to the pixel circuit of the first sub-pixel SP1, which is illustrated in FIG. 3, except that the second data line DL2 is not connected to or is insulated from the parking voltage line PKL.

Specifically, the pixel circuit of the second sub-pixel SP2 may include the driving transistor Td, the first transistor T1, the second transistor T2, the third transistor T3, the fourth transistor T4, the fifth transistor T5, the sixth transistor T6, and the storage capacitor Cst that are identical to those of the pixel circuit of the first sub-pixel SP1.

The pixel circuit of the second sub-pixel SP2 may be connected to the first scan line SL1 in the n-the row, the second scan line SL2 in the n-th row, the third scan line SL3(*n*) in the n-th row, the third scan line SL3(*n*+1) in the (n+1)-th row, the emission control signal line EML, the high potential power line VDD, the low potential power line VSS, initialization signal line IL, and anode reset line RL in the same manner as the pixel circuit of the first sub-pixel SP1.

In addition, the pixel circuit of the first sub-pixel SP1 may be connected to the first data line DL1, and the pixel circuit of the second sub-pixel SP2 may be connected to the second data line DL2. That is, the first sub-pixel SP1 and the second sub-pixel SP2 disposed in different columns may be connected to the data lines DL that are different from each other.

Finally, among the plurality of data lines DL, only the first data line DL1 that is connected to the pixel circuit of the first sub-pixel SP1 may be connected to the parking voltage line PKL, the enable line ENL, and the connection transistor Ten.

Meanwhile, the display device 100 according to an exemplary aspect of the present disclosure may be driven in a frame skip method. In detail, in order to reduce power consumption of the display device 100, an image may be output by low-speed driving in a still image or the like. The frame skip method is one of low-speed driving methods and at the time of driving in the frame skip method, a data voltage may not be input to the pixel circuit in some frames. For example, it may include an active frame in which a data voltage is input and a blank frame in which a data voltage is skipped without being input. In addition, since a data voltage is not input and a data voltage input in a previous frame is maintained in the blank frame, some components of the display device 100 may not be driven and power consumption may be reduced.

Hereinafter, descriptions will be made assuming that the display device 100 according to an exemplary aspect of the present disclosure is driven in the skip frame method.

Figure 5:
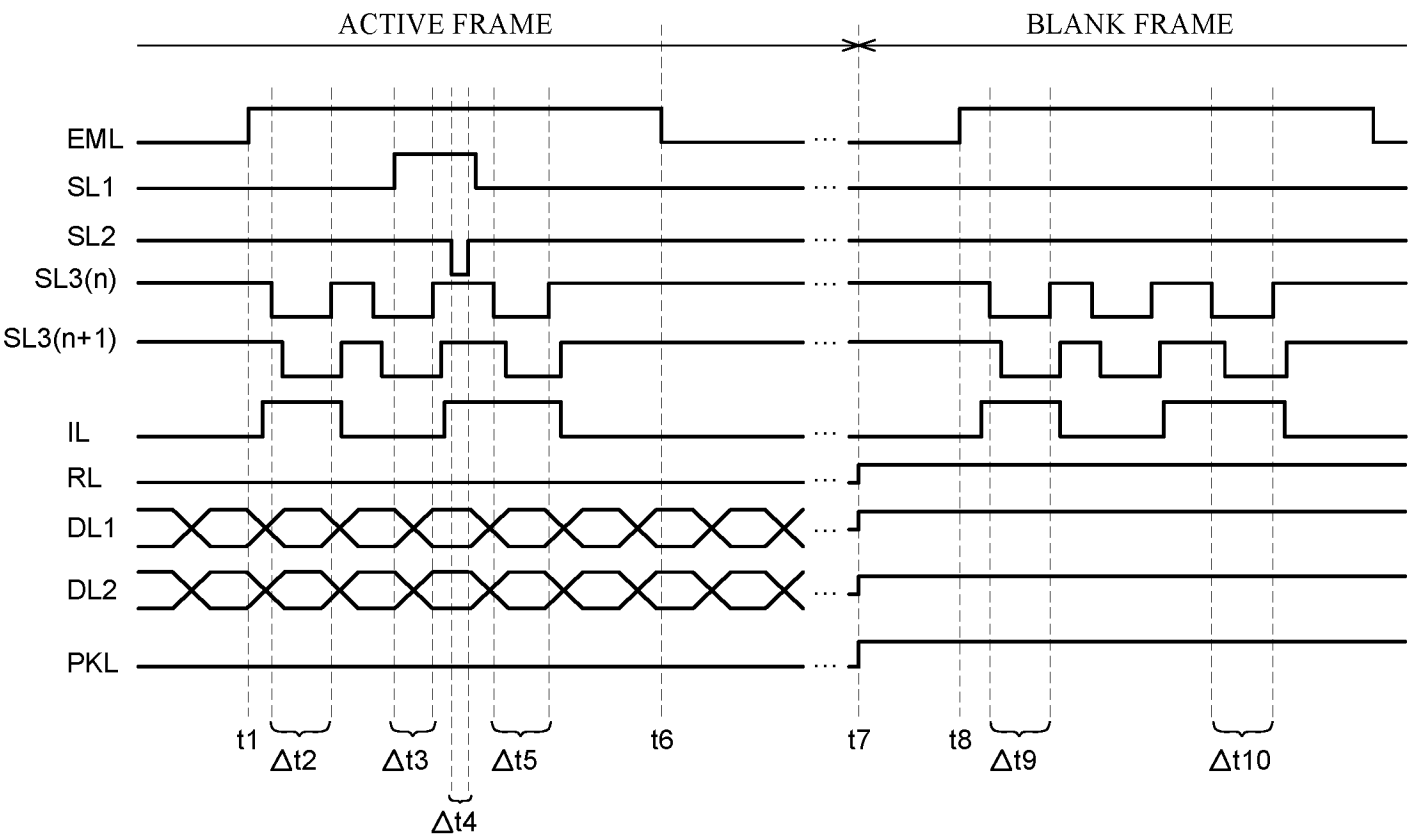
FIG. 5 is a timing diagram illustrating waveforms of signals input to the pixel circuit of the display device according to an exemplary aspect of the present disclosure.

Referring to FIG. 5, the pixel circuit may be driven in an active frame and a blank frame that are divided.

First, at a first time t1 of the active frame, the emission control voltage that is applied to the emission control signal line EML becomes a high level. When the emission control voltage becomes a high level, the second transistor T2 and the fourth transistor T4 that are P-type transistors of which the gate electrodes are connected to the emission control signal line EML may be turned off. In addition, as the second transistor T2 and the fourth transistor T4 are turned off, a driving current may no longer be supplied to the light emitting element OLED and the light emitting element OLED may be turned off. In addition, the emission control voltage may continue to maintain a high level until a sixth time t6.

Next, during a second period Δt2 of the active frame, the third scan voltage of a low level is applied to each of the third scan line SL3(*n*) in the n-th row and the third scan line SL3(*n*+1) in the (n+1)-th row, sequentially. When the third scan voltage of the low level is applied, the third transistor T3 and the sixth transistor T6 that are P-type transistors may be turned on.

During the second period Δt2, the anode reset voltage is applied to the anode reset line RL. Accordingly, the anode reset voltage may be transmitted to the fourth node N4 connected to the anode of the light emitting element OLED through the sixth transistor T6 which is turned on by the third scan voltage.

In addition, the initialization voltage of a high level is applied to the initialization signal line IL during the second period Δt2. Accordingly, the initialization voltage may be transmitted to the third node N3 connected to the drain electrode of the fifth transistor T5, which is an oxide semiconductor transistor, through the third transistor T3 which is turned on by the third scan voltage, so that on-bias stress may be performed.

By performing the on-bias stress, hysteresis of the plurality of transistors may be alleviated. First, the plurality of transistors may have hysteresis in which characteristics thereof in a current frame are varied according to an operation state in a previous frame. For example, even when a data voltage of the same voltage level is supplied to the driving transistor Td, different levels of driving current may be generated according to an operation state in a previous frame. Accordingly, by performing the on-bias stress on the plurality of transistors, a characteristic of the plurality of transistors, that is, a threshold voltage, may be initialized to a constant state. For example, by performing the on-bias stress on each of the plurality of sub-pixels SP, specific transistors of each of the plurality of sub-pixels SP may be initialized to the same state and in the next frame, light of the same luminance may be generated in all of the sub-pixels SP.

Next, a first scan voltage of a high level is applied to the first scan line SL1 during a third period Δt3 of the active frame, and the third scan voltage of a low level is applied to each of the third scan line SL3(*n*) in the n-th row and the third scan line SL3(*n*+1) in the (n+1)-th row, sequentially. In addition, the initialization voltage of a low level is applied to the initialization signal line IL.

When the first scan voltage of the high level is applied to the first scan line SL1, the fifth transistor T5 which an N-type transistor, may be turned on. In addition, when the fifth transistor T5 is turned on, the driving transistor Td of which the gate electrode and the drain electrode are respectively connected to the fifth transistor T5 may be diode-connected.

In addition, when the third scan voltage of a low level is applied to the third scan line SL3(*n*) in the n-th row and the third scan line SL3(*n*+1) in the (n+1)-th row during the third period Δt3, the third transistor T3 and the sixth transistor T6 that are P-type transistors may be turned on. Accordingly, the initialization voltage of the low level may be transmitted to the drain electrode of the driving transistor Td, which is the third node N3, through the turned-on third transistor T3. And the anode reset voltage may be transmitted back to the anode of the light emitting element OLED through the turned-on sixth transistor T6. Accordingly, the third period Δt3 may also be referred to as an initialization period.

Next, during a fourth period Δt4 of the active frame, the first scan voltage of the first scan line SL1 maintains a high level, and the second scan voltage of a low level is applied to the second scan line SL2. Accordingly, the fifth transistor T5 and the first transistor T1 that are connected to the first scan line SL1 and the second scan line SL2 may be turned on.

When the first transistor T1 is turned on, the data voltage may be transmitted from the data line DL to the source electrode of the driving transistor Td through the first transistor T1. At this time, the driving transistor Td is in a diode-connected state by the turned-on fifth transistor T5, and a current may flow between the source electrode and the drain electrode of the driving transistor Td. In addition, when a current flows from the source electrode to the drain electrode of the driving transistor Td, a voltage of the second node N2 to which the gate electrode of the driving transistor Td is connected may continuously increase. Accordingly, during the fourth period Δt4, the voltage of the second node N2 may increase to a value obtained by subtracting a threshold voltage of the driving transistor Td from the data voltage, and the threshold voltage of the driving transistor Td may be sampled.

A specific voltage may also be stored in the storage capacitor Cst of which the second capacitor electrode is connected to the second node N2 and the gate electrode of the driving transistor Td. A difference between a high potential power voltage that is applied to the first capacitor electrode and a voltage that is applied to the second capacitor electrode may be stored in the storage capacitor Cst. For example, a voltage obtained by subtracting a difference between the data voltage and the threshold voltage of the driving transistor Td from the high potential power voltage may be stored in the storage capacitor Cst. That is, a voltage of VDD−(Vdata−Vth) may be stored in the storage capacitor Cst. Accordingly, the fourth period Δt4 is a sampling period and may also be referred as to a programming period.

Next, on-bias stress may be performed during the fifth period Δt5 of the active frame. In the fifth period Δt5, the same voltages as those of the second period Δt2 may be applied. Specifically, the third scan voltage of the low level is applied sequentially to each of the third scan line SL3(*n*) in the n-th row and the third scan line SL3(*n*+1) in the(n+1)-th row, so the third transistor T3 and the sixth transistor T6 may be turned on.

In addition, the anode reset voltage may be transmitted to the fourth node N4 and the anode of the light emitting element OLED through the turned-on sixth transistor T6, and the initialization voltage may be transmitted to the third node N3 that is connected to the drain electrode of the fifth transistor T5, which is an oxide semiconductor transistor, through the turned-on third transistor T3, so that the on-bias stress may be performed.

Next, during a period between the sixth time t6 and an eighth time t8, the emission control voltage of the emission control signal line EML becomes a low level, and the second transistor T2 and the fourth transistor T4 that are P-type transistors are turned on. As the second transistor T2 is turned on, the first node N1, which is the source electrode of the driving transistor Td may rise to a high potential power voltage. In addition, a current that flows through the driving transistor Td may be proportional to a voltage obtained by subtracting the threshold voltage from a voltage Vsg between the source electrode and the gate electrode of the driving transistor Td. Accordingly, the voltage obtained by subtracting the threshold voltage from the voltage between the source electrode and the gate electrode can be the value obtained by subtracting the threshold voltage from a value obtained by subtracting the difference between the data voltage stored in the driving transistor Td in the fourth period and the threshold voltage of the driving transistor Td from the high potential power voltage. Therefore, voltage obtained by subtracting the threshold voltage from the voltage between the source electrode and the gate electrode can be a voltage of VDD−Vdata.

$$Vsg-Vth=VDD-(Vdata-Vth)-Vth=VDD-Vdata \quad \text{[Formula 1]}$$

Accordingly, the current flowing in the light emitting element OLED from the sixth time t6 to the eighth time t8 may be constant all the time regardless of a change in the threshold voltage of the driving transistor Td, and a constant luminance of the display device 100 may be maintained. Accordingly, a period from the sixth time t6 to the eighth time t8 may also be referred to as an emission period.

Next, in order to reduce flicker at a seventh time t7 between the active frame and the blank frame, the anode reset voltage from the anode reset line RL may be adjusted to a specific level. The anode reset voltage is adjusted to a specific level, so that flicker caused by various signals toggled between the active frame and the blank frame may be removed and changes in luminance may be minimized. If flicker occurs, it may be recognized that luminance of the plurality of sub-pixels SP is changed in a data update cycle, and image quality may be degraded.

In the seventh time t7, the data voltage of the data line DL and a parking voltage of the parking voltage line PKL may be set to a predetermined voltage level. For example, the data voltage and the parking voltage may be maintained at a specific level from the seventh time t7 to a next active frame. That is, during the blank frame, the data voltages of the data lines DL may be parked at a predetermined voltage level to reduce power consumption.

Next, during the eighth time t8 to a tenth period Δt10 in the blank frame, a voltage which is the same as that of the active frame may be applied to the emission control signal line EML, the third scan line SL3(*n*) in the n-th row, and the third scan line SL3(*n*+1) in the (n+1)-th row, and the initialization signal line IL. In the blank frame, the first scan voltage of the first scan line SL1, the second scan voltage of the second scan line SL2, the data voltage of the data line DL, and the parking voltage of the parking voltage line PKL may be applied somewhat differently from those in the active frame.

Specifically, the first scan voltage of the first scan line SL1 in the active frame is at a high level during the third period Δt3 to the fourth period Δt4, but the first scan voltage of the first scan line SL1 in the blank frame may continuously maintain a low level.

In the active frame, the second scan voltage of the second scan line SL2 is at a low level during the fourth period Δt4, but the second scan voltage of the second scan line SL2 in the blank frame may continue to maintain a high level.

Although the anode reset voltage of the anode reset line RL maintains a constant level of voltage during the active frame, the anode reset voltage in the blank frame may continue to maintain a higher level of voltage than that in the active frame.

In the active frame, the data voltage of the data line DL is an alternating current (AC) voltage, but in the blank frame, the data voltage of the data line DL may be a direct current (DC) voltage of a constant level in order to reduce power consumption.

Meanwhile, although not illustrated in the drawings, an enable voltage may be applied to the enable line ENL during the blank frame. When the enable voltage is applied, the connection transistor Ten may be turned on. In addition, the parking voltage line PKL may be electrically connected to the first data line DL1 of the plurality of data lines DL through the turned-on connection transistor Ten. Accordingly, the data voltage applied to the first data line DL1 during the blank frame may be equally applied to the parking voltage line PKL.

In summary, in the eighth time t8, a voltage which is the same as that of the first time t1 may be applied, and in a ninth period Δt9, a voltage which is the same as that of the second period Δt2 may be applied, so that on-stress bias may be performed. In addition, in the tenth period Δt10, a voltage which is the same as that of the fifth period Δt5 may be applied, so that on-stress bias may be performed.

In the third period Δt3, the first scan voltage of a high level is supplied, and in the fourth period Δt4, the first scan voltage of a high level and the second scan voltage of a low level are supplied, so that the driving transistor Td is diode-connected, and the data voltage may be supplied to the pixel circuit. Accordingly, the threshold voltage of the driving transistor Td may be sampled and the data voltage may be stored in the storage capacitor Cst. On the other hand, between the ninth period Δt9 and the tenth period Δt10, since the first scan voltage maintains a low level and the second scan voltage maintains a high level, the data voltage is not supplied to the pixel circuit, and the driving transistor Td is also not diode-connected, so that the threshold voltage of the driving transistor Td may not be sampled. That is, in the blank frame, no data voltage is input to the pixel circuit and only on-bias stress is performed, so a change in characteristics of the pixel circuit can be minimized.

Meanwhile, in the display device 100 according to an exemplary aspect of the present disclosure, by disposing the plurality of parking voltage lines PKL that are electrically connected to the first data lines DL1 during the blank frame, a parasitic capacitance with the driving transistor Td may be increased and flicker may be reduced. Specifically, by applying the same DC voltage to the first data line DL1 and the parking voltage line PKL during the blank frame, the parking voltage line PKL forms a parasitic capacitance with the driving transistor Td, so that flicker may be reduced. Specifically, in the pixel circuit, there may occur coupling noise in which voltages in the first node N1, the second node N2, the third node N3, the fourth node N4 and the like that are connected to the driving transistor Td are changed by voltage coupling due to adjacent components, for example, various lines or a gate driver GD. In this case, luminance variances may be caused by the noise due to the coupling, and flicker may occur. At this time, the data line DL and the parking voltage line PKL are disposed between the plurality of sub-pixels SP, and a DC voltage of a constant level is applied, so that a parasitic capacitance may be formed between the pixel circuit (or driving transistor) and the data line DL and between the pixel circuit (or driving transistor) and the parking voltage line PKL, and variation of voltages in the first node N1, the second node N2, the third node N3 and the fourth node N4 may be minimized. Accordingly, in the display device 100 according to an exemplary aspect of the present disclosure, by disposing the plurality of data lines DL and the plurality of parking voltage lines PKL between the plurality of sub-pixels SP, and applying a DC signal to the plurality of data lines DL and the plurality of parking voltage lines PKL during the blank frame, flicker caused by coupling noise can be reduced.

The exemplary aspects of the present disclosure can also be described as follows:

According to an aspect of the present disclosure, there is provided a display device. The display device includes a substrate on which a plurality of first sub-pixels disposed in first columns and a plurality of second sub-pixels disposed in second columns are defined, a plurality of data lines disposed on one sides of the plurality of first sub-pixels and the other sides of the plurality of second sub-pixels, and a plurality of parking voltage lines disposed between the plurality of first sub-pixels and the plurality of second sub-pixels. The plurality of parking voltage lines are configured to be electrically connected to some of the plurality of data lines.

The display device may further include a connection transistors configured to electrically connect the plurality of parking voltage lines and first data lines of the plurality of data lines, and an enable line electrically connected to gate electrodes of the connection transistors.

When a DC signal is applied to the first data lines, a turn-on voltage of the connection transistors may be applied to the enable line, so that the plurality of parking voltage lines and the first data lines are electrically connected.

The first data lines may be disposed on the one sides of the plurality of first sub-pixels and the plurality of parking voltage lines may be disposed on the other side of the plurality of first sub-pixels.

A second data lines of the plurality of data lines may be disposed on the one sides of the plurality of first sub-pixels and may be insulated from the plurality of parking voltage lines.

The plurality of first sub-pixels may include a plurality of green sub-pixels, and the plurality of second sub-pixels may include a plurality of red sub-pixels and a plurality of blue sub-pixels.

The plurality of first sub-pixels and the plurality of second sub-pixels may have a flip structure.

The display device may further include a pixel circuit disposed in each of the plurality of first sub-pixels and the plurality of second sub-pixels. The pixel circuit may include a driving transistor including low-temperature polysilicon, a first transistor connected between the driving transistor and the plurality of data lines, a second transistor coupled to the driving transistor and the first transistor, a third transistor connected between the driving transistor and an initialization line, a fourth transistor connected between the driving transistor and a light emitting element, a fifth transistor connected to the gate electrode of the driving transistor, and a sixth transistor connected with the light emitting element and the fourth transistor. The fifth transistor may include an oxide semiconductor.

The plurality of parking voltage lines and the driving transistor, and the plurality of data lines and the driving transistor may form a parasitic capacitance.

According to another aspect of the present disclosure, there is provided a display device. The display device includes a substrate on which a plurality of first sub-pixels disposed in first columns and a plurality of second sub-pixels disposed in second columns are defined, a plurality of pixel circuits disposed in the plurality of first sub-pixels and the plurality of second sub-pixels, a plurality of data lines extending in a column direction between the plurality of first sub-pixels and the plurality of second sub-pixels and connected to the plurality of pixel circuits, and a plurality of parking voltage lines extending in the column direction between the plurality of first sub-pixels and the plurality of second sub-pixels and separated from the plurality of pixel circuits. The plurality of parking voltage lines are disposed in columns in which the plurality of data lines are not disposed among a plurality of columns.

Each of the plurality of pixel circuits may include a driving transistor connected to a light emitting element, a first transistor connecting the driving transistor and the plurality of data lines, a second transistor connecting the driving transistor and a high potential power line, a third transistor connecting the driving transistor and an initialization line, a fourth transistor connected to the light emitting element and an emission control line, a fifth transistor connected to the driving transistor and a storage capacitor, and a sixth transistor connecting the light emitting element and a reset line. In the plurality of pixel circuits, at least the fifth transistor may include an oxide semiconductor.

During a blank frame in which a direct current (DC) voltage is applied to the plurality of data lines, the plurality of parking voltage lines may be electrically connected to some data lines among the plurality of data lines. During an active frame in which an alternating current (AC) voltage is applied to the plurality of data lines, the plurality of parking voltage lines may be electrically insulated from the some data lines.

The display device may further include a plurality of connection transistors connecting the some data lines and the plurality of parking voltage lines, and an enable line electrically connected to gate electrodes of the plurality of connection transistors. The plurality of connection transistors may be turned on during the blank frame, and the plurality of connection transistors may be turned off during the active frame.

During the blank frame, the first transistor and the fifth transistor may be turned off, the sixth transistor may transmit a reset voltage to an anode of the light emitting element, and the third transistor may transmit an initialization voltage to a node between the driving transistor and the fifth transistor.

Although the exemplary aspects of the present disclosure have been described in detail with reference to the accompanying drawings, the present disclosure is not limited thereto and may be embodied in many different forms without departing from the technical concept of the present disclosure. Therefore, the exemplary aspects of the present disclosure are provided for illustrative purposes only but not intended to limit the technical concept of the present disclosure. The scope of the technical concept of the present disclosure is not limited thereto. Therefore, it should be understood that the above-described exemplary aspects are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display device, comprising:

a substrate on which a plurality of first sub-pixels disposed in first columns and a plurality of second sub-pixels disposed in second columns are defined;

a plurality of data lines disposed on one sides of the plurality of first sub-pixels and another sides of the plurality of second sub-pixels; and a plurality of parking voltage lines disposed between the plurality of first sub-pixels and the plurality of second sub-pixels, wherein the plurality of parking voltage lines are electrically connected to some of the plurality of data lines, and wherein the plurality of parking voltage lines and the plurality of data lines are different and separated from each other.

2. The display device of claim 1, further comprising:

connection transistors electrically connecting the plurality of parking voltage lines and first data lines of the plurality of data lines; and an enable line electrically connected to gate electrodes of the connection transistors.

3. The display device of claim 2, wherein the connection transistors is connected to the enable line, so that the plurality of parking voltage lines and the first data lines are electrically connected with each other.

4. The display device of claim 3, wherein the first data lines are disposed on the one sides of the plurality of first sub-pixels and the plurality of parking voltage lines are disposed on the another side of the plurality of first sub-pixels.

5. The display device of claim 4, wherein the second data lines of the plurality of data lines are disposed on the one sides of the plurality of first sub-pixels and are insulated from the plurality of parking voltage lines.

6. The display device of claim 5, wherein the plurality of first sub-pixels includes a plurality of green sub-pixels, and the plurality of second sub-pixels includes a plurality of red sub-pixels and a plurality of blue sub-pixels.

7. The display device of claim 1, wherein the plurality of first sub-pixels and the plurality of second sub-pixels have a flip structure.

8. The display device of claim 1, further comprising a pixel circuit disposed in each of the plurality of first sub-pixels and the plurality of second sub-pixels, wherein the pixel circuit includes:

a driving transistor including low-temperature polysilicon;

a first transistor connected between the driving transistor and the plurality of data lines;

a second transistor coupled to the driving transistor and the first transistor;

a third transistor connected between the driving transistor and an initialization line;

a fourth transistor connected between the driving transistor and a light emitting element;

a fifth transistor connected to the gate electrode of the driving transistor; and a sixth transistor connected with the light emitting element and the fourth transistor.

9. The display device of claim 8, wherein the fifth transistor includes an oxide semiconductor.

10. The display device of claim 8, wherein the plurality of parking voltage lines and the driving transistor and the plurality of data lines and the driving transistor form a parasitic capacitance.

11. A display device, comprising:

a substrate on which a plurality of first sub-pixels disposed in first columns and a plurality of second sub-pixels disposed in second columns are defined;

a plurality of pixel circuits disposed in the plurality of first sub-pixels and the plurality of second sub-pixels;

a plurality of data lines extending in a column direction between the plurality of first sub-pixels and the plurality of second sub-pixels and connected to the plurality of pixel circuits; and a plurality of parking voltage lines extended in the column direction between the plurality of first sub-pixels and the plurality of second sub-pixels and separated from the plurality of pixel circuits, wherein the plurality of parking voltage lines are disposed in columns in which the plurality of data lines are not disposed among a plurality of columns, and wherein the plurality of parking voltage lines and the plurality of data lines are different and separated from each other.

12. The display device of claim 11, wherein each of the plurality of pixel circuits includes, a driving transistor connected to a light emitting element;

a first transistor connecting the driving transistor and the plurality of data lines;

a second transistor connecting the driving transistor and a high potential power line;

a third transistor connecting the driving transistor and an initialization line;

a fourth transistor connected to the light emitting element and an emission control line;

a fifth transistor connected to the driving transistor and a storage capacitor; and a sixth transistor connecting the light emitting element and a reset line.

13. The display device of claim 12, wherein the fifth transistor includes an oxide semiconductor.

14. The display device of claim 11, wherein, during a blank frame in which a direct current (DC) voltage is applied to the plurality of data lines, the plurality of parking voltage lines are electrically connected to some data lines among the plurality of data lines, and wherein, during an active frame in which an alternating current (AC) voltage is applied to the plurality of data lines, the plurality of parking voltage lines are electrically insulated from the some data lines.

15. The display device of claim 14, further comprising:

a plurality of connection transistors connecting the some data lines and the plurality of parking voltage lines; and an enable line electrically connected to gate electrodes of the plurality of connection transistors.

16. The display device of claim 15, wherein the plurality of connection transistors are turned on during the blank frame, and the plurality of connection transistors are turned off during the active frame.

17. The display device of claim 14, wherein, during the blank frame, the first transistor and the fifth transistor are turned off, the sixth transistor transmits a reset voltage to an anode of the light emitting element, and the third transistor transmits an initialization voltage to a node between the driving transistor and the fifth transistor.

* * * * *